US009102450B2

(12) United States Patent
Sheahan

(10) Patent No.: US 9,102,450 B2
(45) Date of Patent: Aug. 11, 2015

(54) TUBULAR CONTAINER

(76) Inventor: Mark Sheahan, London (GB)

( * ) Notice: Subject to any disclaimer, the term of this patent is extended or adjusted under 35 U.S.C. 154(b) by 821 days.

(21) Appl. No.: 12/083,025

(22) PCT Filed: Sep. 28, 2006

(86) PCT No.: PCT/GB2006/003611
§ 371 (c)(1),
(2), (4) Date: Apr. 2, 2008

(87) PCT Pub. No.: WO2007/039711
PCT Pub. Date: Apr. 12, 2007

(65) Prior Publication Data

US 2009/0230142 A1 Sep. 17, 2009

(30) Foreign Application Priority Data

Oct. 4, 2005 (GB) ..... 0520171.0

(51) Int. Cl.
*B65D 43/16* (2006.01)
*B65D 55/16* (2006.01)

(52) U.S. Cl.
CPC ..... *B65D 55/16* (2013.01); *B65D 2251/01* (2013.01); *B65D 2251/1066* (2013.01)

(58) Field of Classification Search
CPC ..... B65D 55/16; B65D 2251/01; B65D 2251/1066
USPC ..... 215/209; 220/264, 810, 834, 838, 220/254.7, 263, 798, 916
See application file for complete search history.

(56) References Cited

U.S. PATENT DOCUMENTS

| | | | | | |
|---|---|---|---|---|---|
| 3,790,015 | A | * | 2/1974 | Imamura | 215/209 |
| 3,907,103 | A | * | 9/1975 | Shaw | 206/1.5 |
| 3,968,880 | A | * | 7/1976 | Ostrowsky | 206/540 |
| 4,043,448 | A | * | 8/1977 | Tanaka | 206/1.5 |
| 4,144,985 | A | * | 3/1979 | Kinslow | 220/254.3 |
| 4,163,496 | A | * | 8/1979 | Dogliotti | 206/538 |
| 4,462,504 | A | | 7/1984 | Roth et al. | |

(Continued)

FOREIGN PATENT DOCUMENTS

GB 2116952 10/1983

*Primary Examiner* — Fenn Mathew
*Assistant Examiner* — Elizabeth Volz

(57) ABSTRACT

A tubular container (2) which comprises a tubular body portion (6), a lid (8) for closing a first end of the body portion (6), a strengthening member (7) at the first end of the body portion (6), and an end closure Member (17) for closing a second end of the body portion (6), the strengthening member (7) being attached to the lid (8) by a hinge which is formed to be integral with the strengthening member (7) and the lid (8), the lid (8) being such that it fits into the strengthening member (7), the strengthening member (7) being such that it has a skirt portion (13) inside the first end of the body portion (6) and a pair of oppositely positioned extension members (15) which extend from the skirt portion (13) into the body portion (6) and which are for receiving pressure applied to the body portion (6) in order to ensure that the strengthening member (7) deforms so as to enable the lid (8) to pop open and in order to ensure that the pressure does not collapse the first end of the body portion (6), the lid (8) having a concave portion (18) for receiving part (16) of the strengthening member (7) that is inwardly deformed by the pressure, the lid (8) having a flap (28) that flexes in response to the inward deformation of the part (16) of the strengthening member (7), and the lid (8), the fixing member (7) and the end closure member (17) all being made of a plastics material.

14 Claims, 3 Drawing Sheets

(56) References Cited

U.S. PATENT DOCUMENTS

| | | | | | |
|---|---|---|---|---|---|
| 4,538,731 | A | * | 9/1985 | Cillario | 206/540 |
| 4,618,066 | A | * | 10/1986 | Vail | 215/13.1 |
| 4,782,964 | A | * | 11/1988 | Poore et al. | 215/216 |
| 4,850,504 | A | * | 7/1989 | Gindrod et al. | 220/787 |
| 4,889,238 | A | * | 12/1989 | Batchelor | 206/535 |
| 5,033,634 | A | * | 7/1991 | Batchelor et al. | 220/281 |
| 5,295,496 | A | * | 3/1994 | Machelett | 132/293 |
| 5,346,069 | A | * | 9/1994 | Intini | 206/531 |
| 5,575,399 | A | * | 11/1996 | Intini | 220/835 |
| 5,699,912 | A | * | 12/1997 | Ishikawa et al. | 206/494 |
| 5,718,347 | A | * | 2/1998 | Walker et al. | 215/209 |
| 5,788,064 | A | * | 8/1998 | Sacherer et al. | 206/204 |
| 5,887,736 | A | * | 3/1999 | Mar | 215/213 |
| 6,199,710 | B1 | * | 3/2001 | Jensen | 215/228 |
| 6,367,639 | B1 | * | 4/2002 | Mar | 215/213 |
| 6,510,971 | B1 | * | 1/2003 | Martin | 222/556 |
| 6,520,331 | B2 | * | 2/2003 | Okin et al. | 206/494 |
| 6,561,391 | B1 | | 5/2003 | Baker | |
| 7,296,711 | B2 | * | 11/2007 | Hayakawa et al. | 222/153.14 |
| 7,651,002 | B2 | * | 1/2010 | Hennemann et al. | 215/235 |
| 7,712,618 | B2 | * | 5/2010 | Barre et al. | 215/237 |
| 2002/0148802 | A1 | * | 10/2002 | Takahashi et al. | 215/237 |
| 2004/0238553 | A1 | * | 12/2004 | Lane et al. | 220/835 |
| 2005/0045503 | A1 | * | 3/2005 | Wong et al. | 206/308.2 |
| 2006/0249534 | A1 | * | 11/2006 | Sainz | 222/92 |
| 2007/0251949 | A1 | * | 11/2007 | Barre et al. | 220/890 |
| 2009/0230142 | A1 | * | 9/2009 | Sheahan | 220/810 |
| 2010/0270305 | A1 | * | 10/2010 | Yamamoto et al. | 220/315 |

* cited by examiner

TUBULAR CONTAINER

This invention relates to a tubular container which is suitable for containing a wide variety of solid, granular and powdered products such for example as confectionery, gravy granules and dried foods. It is also suitable for use as a protective container for example for glass bottles.

Products are packaged as attractively as possible in order to sell the products. There are thus many different known types of containers including tubular containers and a wide variety of boxes. Manufacturers, are constantly trying to improve on their packaging in order to facilitate sales of their products against competing products. In addition, changes in packaging are often required due to changes in legislation, consumer pressure and safety issues.

It is an aim of the present invention to provide a tubular container which has advantages over known tubular containers.

Accordingly, the present invention provides a tubular container which comprises a tubular body portion, a lid for closing a first and open end of the body portion, and a strengthening member at the first open end of the body portion, the strengthening member being attached to the lid by a hinge which is formed to be integral with the strengthening member and the lid, the strengthening member being such that it fits inside the first open end of the body portion and defines an opening through which product in the tubular container is obtained, the lid being such that it fits into the opening defined by the strengthening member, the strengthening member being such that it has a skirt portion inside the first open end of the body portion and a pair of oppositely positioned extension members which extend from the skirt portion into the body portion and which are for receiving inward pressure applied to a pressable area of the body directly next to the lid in order to ensure that the strengthening member deforms and causes the lid to pop open and prevents the inward pressure permanently collapsing the first open end of the body portion, the lid having a concave portion for receiving part of the strengthening member that is inwardly deformed by the pressure, the lid having a flap that flexes in response to the inward deformation of the part of the strengthening member, the part of the strengthening member that inwardly deforms pushes the flap upwards as the flap flexes, the concave portion and the flap being such that they are in the opening defined by the strengthening member when the lid is closed on the body portion, the concave portion being such that it faces longitudinally into the body portion when the lid is closed on the body portion, the body portion having a second and closed end, and the lid, the strengthening member and the second and closed end all being made of a plastics material.

The tubular container of the present invention can be made in a wide variety of sizes, for example in dependence upon the type of product that the tubular container is to contain. The tubular container will usually be of a circular cross sectioned shape, but it may be of other cross sectioned shapes if desired, for example octagonal or hexagonal. The tubular container is such that its lid is easily opened and thus the tubular container may be regarded as an easy open container suitable for a wide range of products, and easily used by a wide range of people including people with reduced hand mobility for example due to age or arthritis, and non-sighted people. The container can be opened by people using one hand or both hands.

The tubular container may advantageously be constructed to look like the well known tubular container for containing Smarties (registered trade mark). The tubular container can be produced to retain the known features of existing Smarties' tubular containers which are made of a cardboard body and base with a plastics lid. The existing cardboard tubular containers for Smarties are such that when they are empty, the body portion can be quickly crushed, for example by being hit between a person's hands or by being stamped on, and this will cause the plastics lid to pop off the body portion with a popping sound. With the tubular container of the present invention, the lid can be arranged to pop off the body portion with a popping sound whenever the pressable area is pressed, this being irrespective of whether or not the body portion contains a product. Thus the ability constantly to remove the lid from the body portion with a popping action provides an extra amusement facility for children. Because the lid is integrally formed with the fixing member which is fixed to the body portion, the lid does not fly off the body portion and possibly get lost or contaminated each time the container is popped open. Parents of young children are saved the problem of having to retrieve the lid each time it is popped off.

The traditional tubular containers have a main body and base which are made of cardboard so that children and adults generally cannot see how many Smarties are left in the container. This is believed to be a selling feature and so the tubular container of the present invention can be made of a non-transparent material which thus enables the same advantage as in the traditional tubular container to be retained. If desired however, the container of the present invention can be transparent.

If desired, the tubular container of the present invention can be made to be similar in overall dimensions such that it conforms to the existing requirements for processing product lines, transit packaging and shelf space at point of sales. The internal dimensions of the tubular container can also be the same as traditional containers so that confectionery can be inserted in the tubular container of the present invention in the same way as has previously been done with traditional tubular containers.

Preferably, the strengthening member is separately formed from the body portion and pushes into the body portion. If desired however, the strengthening member can be moulded integrally with the body portion. The strengthening member acts to strengthen the first end of the body portion in order to ensure that the first end of the body portion does not collapse under repeated pressure for opening the tubular container. The strengthening member also acts as a fixing member.

Preferably, the end closure member is separately formed from the body portion and pushes into the body portion. If desired however, the end closure member may be moulded integrally with the body portion. The tubular container may thus be moulded in one piece if the strengthening member and the end closure members are both moulded integrally with the body portion. Any suitable and appropriate plastics material may be employed.

The body portion may be made of a plastics material or another material such for example as cardboard. Advantageously, the lid, the fixing member, the end closure member and the body portion are all made of the same type of plastics material so that the tubular container is then simple to recycle.

The popping sound that occurs when the lid comes off the fixing member due to pressing the pressable part occurs as the lid suddenly moves away from the fixing member. Initially, the lid will start to slip off the fixing member and then it will suddenly leave the fixing member, whereupon the pop will be heard. Confectionery such for example as Smarties is able to move inside the body portion (ullage) and thus the body portion can be inwardly pressed at the pressable area to cause the lid to pop off the body portion even when the body portion is full with product.

Generally the lid will be a firm snap in and secure fit and as airtight as necessary to achieve a good popping sound. The popping sound is amplified by the concave shape of the lid acting as an acoustic box.

The strengthening member and the end closure member will normally be fixed to the body portion using a fusing system for a plastics body that makes the join completely airtight. Where the body portion is made of cardboard, then the strengthening member and the end closure member may be press fitted and glued in position. The lid fitment, however well secured, will normally not be completely airtight. This is desirable as it allows the product in the container to breath. This is especially important where the product is confectionery having a chocolate base. The lid should however close the fixing member sufficiently such that not too much air is available to the confectionery such that the confectionery prematurely goes stale.

Preferably, the tubular container is one in which the body portion is circular in cross section. The body portion may be of other cross sectional shapes if desired so that, for example, the body portion may be triangular, square, hexagonal or octagonal in cross sectional shape if desired. The lid, the fixing member and the end closure member will normally be of a complementary shape.

The lid can be manufactured to be a good fit into the fixing member so that fitment problems such as exist with known Smarties' containers are overcome.

Advantageously, the hinge has side edges which are V-shaped so that if the lid is torn from the fixing member at the hinge, any parts of the hinge on the lid and the strengthening member will have less sharp corners than if the hinge had straight side edges. If desired, the hinge can be constructed as a rip hinge which tears along a predetermined path. The lid can then be removable with one twist only, leaving a minimal residue of material on the lid. This construction is thus particularly advantageous because young children are prone to tearing the lid from the body portion and then possibly swallowing the lid. In such an event, it is highly advantageous if the lid has a minimum of sharp edges likely to cause injury to the child swallowing the lid.

Preferably, the lid has a closure bead that helps to keep the fixing member in shape and adds strength to the pressable area when closed. The tubular container may be one which is such that when the pressable area is pressed, the flap and the bead force against each other and thus help to push the lid upwards, the flap and the bead thereby helping to initiate the start of the easy opening action of the tubular container, and the tubular container also being such that, because the flap is flexible, the flap then flexes and springs off the strengthening member to open the tubular container and create an audible pop. The closure bead thus forms an active element in the opening popping action when pressing the pressable area on opening.

Preferably, the tubular container includes tamper evident means. The tamper evident means is required to be broken before it is possible to open the lid. This helps to dissuade people from trying to open the lid without authority. The tamper evident means is preferably a tamper evident tab which extends between the lid, the fixing member and the body portion. The tamper evident tab is preferably a hologram tamper evident tab. The use of a hologram may also look better in diffuse lighting than a non-hologram tamper evident means. The hologram is more difficult to forge than non-holograms and a paper backed hologram tends to break up easily, clearly showing tampering and thereby preventing resealing of the tamper evident means. A presently preferred hologram is a three-dimensional hologram which is shiny and therefore attractive to many children and is harder to replicate. A hologram having high quality effects may be used. The hologram may be a paper backed hologram. Other materials such for example as film and plastics material such for example as polypropylene may be employed if desired.

The tamper evident means such for example as the tamper evident tab may be provided with instructions for the opening of the tubular container. Thus, for example, the tamper evident tab may include the words "tear tab to open" and "press here to pop open".

The tamper evident means may have easy to tear directional slits or perforations, for example slits or perforations that position themselves between the lid and the fixing member on placement. The slits or perforations may thus ensure that the tamper evident means tears easily and as required.

The provision of tamper evident means is also desirable insofar as confectionery manufacturers may wish to add something inside the body portion which is extra to the confectionery. This added material might be, for example, competition material or a gift which clearly should not be moved prior to sale.

The end closure member may be provided with a design that can be viewed by looking through the body portion from the first end portion in the manner of a telescope. The design may be embossed or debossed, with the plastics material being of a suitable thickness for allowing the design to be seen in silhouette form. Any suitable and desired type of design may be provided on the end closure member. Advantageously, the tubular container is one in which the end closure member is fixed into the body portion such that the light intensity of a silhouette of the design is increased when the design is viewed looking through the body portion from the first end portion in the manner of a telescope.

An embodiment of the invention will now be described solely by way of example and with reference to the accompanying drawings in which.

Figure 1:
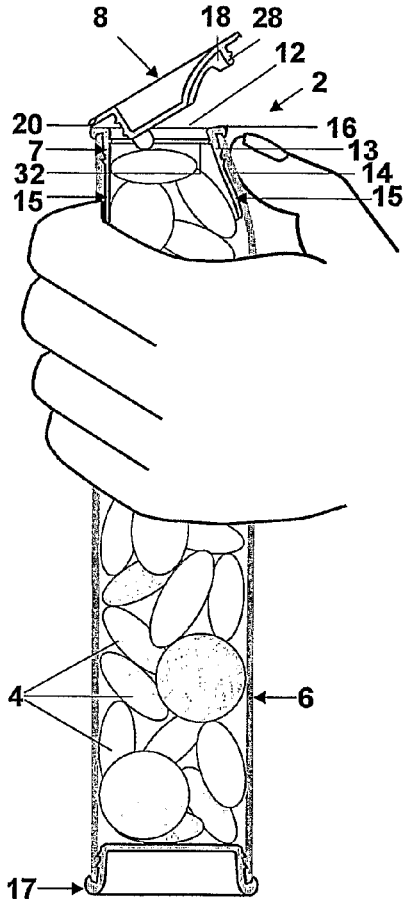
FIG. 1 is a longitudinal sectional view showing a tubular container containing Smarties and being pressed to open a lid on a fixing member fixed to a body portion of the tubular container.

Referring to the drawings, there is shown a tubular container 2 for confectionery in the form of Smarties 4. The tubular container 2 comprises a tubular body portion 6 and a lid 8 which is integrally formed with a strengthening member 7. The lid 8 is a push fit into the strengthening member 7. The strengthening member 7 is for fixing the lid 8 to the body portion 6.

The body portion 6 has a first open end 12, a second open end 10, and a pressable area 14 which is positioned adjacent the open end 12 as shown. The pressable area 14 is inwardly pressable to cause a part 16 of the strengthening member 7 to deform and move inwardly.

The strengthening member 7 has a skirt portion 13 for fitting inside the first end 12 of the body portion 6. The strengthening member 7 also has a pair of oppositely positioned extension members 15 which extend from the skirt portion 13 and which are for receiving pressure applied to the body portion 6 in order to ensure that the strengthening member 7 deforms so as to enable the lid 8 to pop open, and in order to ensure that the pressure does not collapse the first end of the body portion 6.

The body portion 6 has its second open end 10 closed by an end closure member 17.

The lid 8 has a concave portion 18 for receiving the part 16 of the strengthening member 7 which is attached to the open end 12 of the body portion 6 that is inwardly pressable at the pressable area 14.

Figure 7:
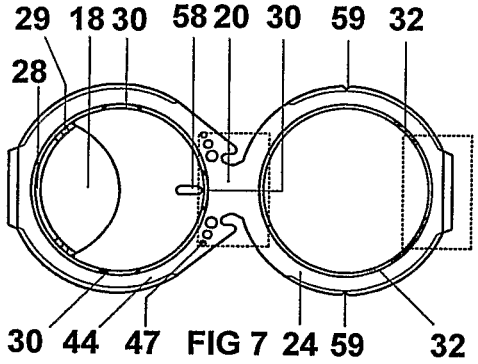
FIG. 7 is a top plan view of the tubular container with the lid in a fully open position.
Figure 12:
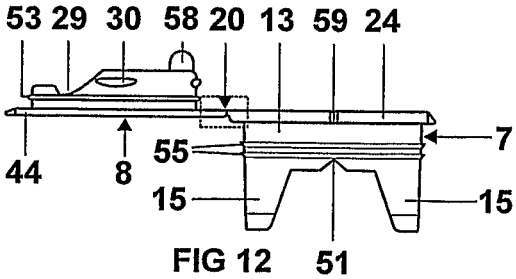
FIG. 12 is a side view of the fixing member remote from the body portion in the open position as shown in FIG. 7.
Figure 13:
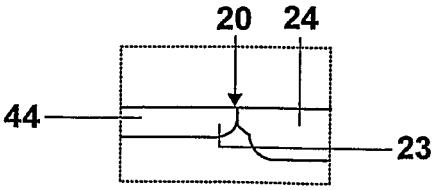
FIG. 13 shows an enlarged detail of the marked part shown in FIG. 12.
Figure 14:
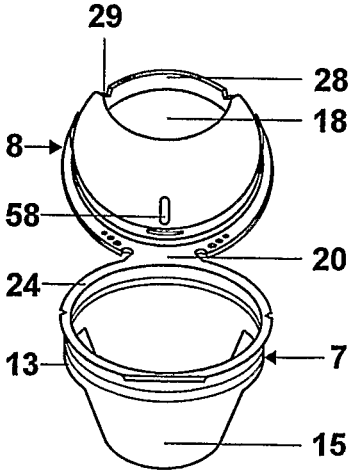
FIG. 14 is a three dimensional view of the combined lid and fixing member in the open position remote from the body part as shown in FIG. 7.
Figure 15:
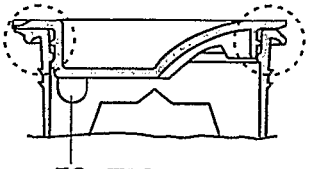
FIG. 15 is a sectional view showing in detail the lid in a closed position in the fixing member.

The part 16 of the strengthening member 7 is such a the flap 28 of the lid 8 is caused to flex, collapse and spring apart from the strengthening member 7 causing a popping sound, when the pressable area 14 is pressed, as shown most clearly in FIGS. 1, 2, 7, 14, 17 and 23. FIGS. 7, 12 and 14 show V-shaped portions 29. These V-shaped portions 29 help to control the flexibility and therefore the degree of deformation of the flap 28 of the lid 8, when the pressable area 14 is pressed. The lid 8, the strengthening member 7 and the end closure member 17 are made of a plastics material. A presently preferred plastics material is polyethylene which facilitates the formation of the hinge. However, any other suitable and appropriate plastics material may be employed. The body portion 6 is preferably made of a cardboard material but it could be made of another material, for example a plastics material.

The body portion 6 is of circular cross section as shown in the drawings.

The lid 8 is integrally formed with the strengthening member 7. More specifically, the lid 8 is joined to the strengthening member 7 by a hinge 20. The lid 8 and the hinge 20 are thus formed of the same plastics material as the strengthening member 7.

Figure 9:
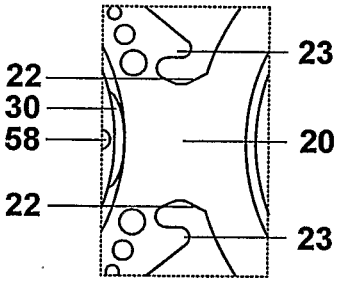
FIG. 9 is an enlarged detail of a hinge part of a tubular container shown in FIG. 7.
Figure 10:
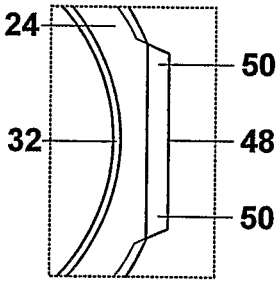
FIG. 10 is an enlarged view of the fixing member and body part as shown in FIG. 7.
Figure 11:
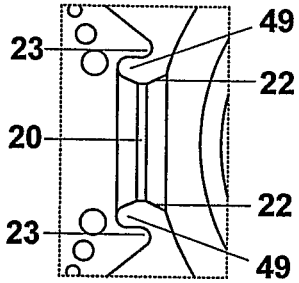
FIG. 11 is an enlarged part of the hinge part as shown in FIG. 8.
Figure 19:
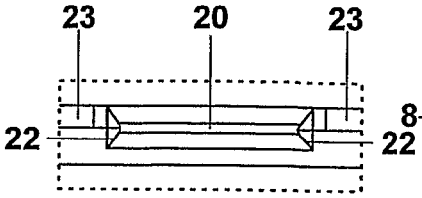
FIG. 19 is an enlarged view of the marked part shown in FIG. 18.
Figure 28:
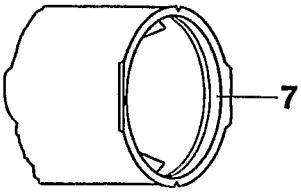
FIG. 28 is a view of the body portion and fixing member with the lid missing.
Figure 29:
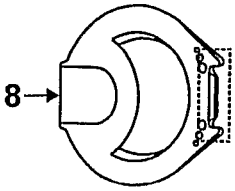
FIG. 29 is a view of the lid remote from the fixing member.
Figure 30:
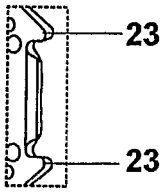
FIG. 30 is an enlarged view of the marked area in FIG. 29.

As shown most clearly in FIGS. 9, 11 and 19, the hinge 20 has side edges 22 which are V-shaped as shown. In the event that a child should tear the lid 8 from the strengthening member 7, then any parts of the hinge 20 on the lid 8 and the strengthening member 7 will have less sharp corners than would be the case if the hinge 20 had straight sides 22. If the child should then swallow the lid 8, the absence of the sharp corners that would otherwise have been present may help to avoid the child becoming injured, for example along its throat or in its stomach. Extended ends 23 act to shield a broken hinge to provide for added safety. More specifically, the extended ends 23 are positioned in such a manner that when the lid 8 is torn from the strengthening member 7, any jagged areas left will be contained by the extended ends 23 and so they will not be exposed if the lid 8 should be swallowed by a child, see FIGS. 28, 29 and 30.

As best seen in FIGS. 7 and 14, the fixing member 7 is defined by a flat bead 24. This arrangement causes the open end of the strengthening member 7 to act like a spring. When the pressable area 14 is pressed and released, it deflects back to its naturally moulded position The flat bead 24 also helps to strengthen up the open end 12 of the body portion when the strengthening member 7 is fixed in position.

Figure 2:
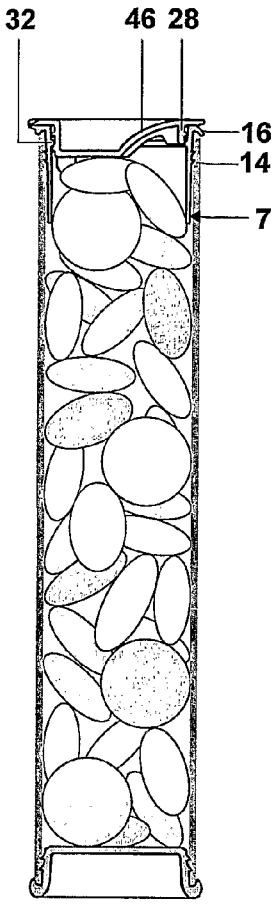
FIG. 2 is a longitudinal side view like FIG. 1 in its closed condition and does not show the body portion being pressed.
Figure 16:
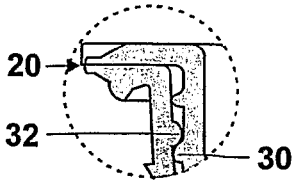
FIG. 16 shows an enlarged detail of the left hand marked part hinge area in FIG. 15.

The lid 8 is a push fit into the strengthening member 7. As best seen from FIGS. 7, 9, 12, 22 and 23, the lid 8 has three closure beads 30. The closure beads 30 snap over a continuous bead 32 projecting from the inside wall of the strengthening member 7 as shown in FIGS. 2 and 16. Thus the lid 8 is a snap fit into the strengthening member 7. If the hinge 20 is broken, the lid 8 will still be retained in the strengthening member 7 by the bead 32 and closure beads 30. Still further, the portion of the bead 30 adjacent the hinge 20 is such that, when the lid 8 closes into the strengthening member 7, the bead 30 engages the bead 32 and pulls the lid 8 in, thereby preventing a gap forming between the lid 8 and the strengthening member 7 at the hinge area.

When the pressable area 14 is pressed, the flap 28 and the bead 32 force against each other and this helps to push the lid 8 upwards. The flap 28 and the bead 32 thus help to initiate the start of the easy opening action which is characteristic of the tubular container 2. After this, because the flap 28 is flexible, it flexes and springs off the strengthening member 7 to open the tubular container 2 and create the audible pop.

If the hinge 20 is manufactured to be thin, the lid 8 can be opened and the lid 8 can fall or be pushed completely to one side of the body portion 6. The lid will then stay in this position and the first open end 12 of the body portion 6 is then unobstructed. A person can then tip the open end 12 to their mouth and pour the contents of the container 2, for example, the Smarties 4, into their mouth.

Figure 3:
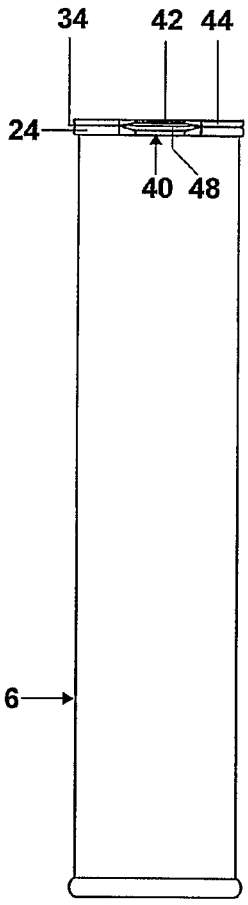
FIG. 3 is a front view of the container shown in FIGS. 1 and 2 with the lid in a closed position.
Figure 20:
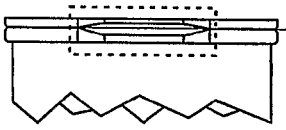
FIG. 20 is a front view of part of the tubular container and shows the lid in a closed condition in the fixing member on the body portion.

It may sometimes be desired that a person such as an adult wants to open the tubular container 2 and without the popping noise. The person is able to do this by sliding his or her thumbnail or fingernail into the gap 34 as shown in FIGS. 3 and 20 to prize the lid 8 away from the strengthening member 7 without any noise. More specifically, the person is able to slide his or her thumbnail under the bead 44 of the lid 8 into the recess 48 of the strengthening member 7 and lift the lid 8 away from the strengthening member 7 without any noise, as best shown in FIGS. 3, 10, 17 and 21.

Figure 4:
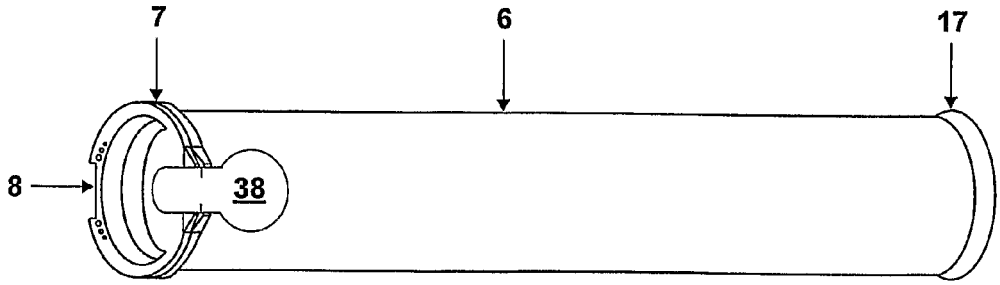
FIG. 4 is a three dimensional view of the tubular container in its closed condition with a tab applied.
Figure 17:
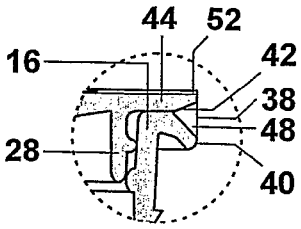
FIG. 17 shows an enlarged detail of the right hand marked part shown in FIG. 15.
Figure 18:
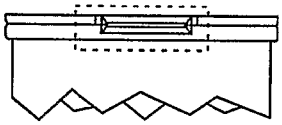
FIG. 18 is a rear view of the container and shows a hinge which connects the lid to the fixing member.
Figure 21:
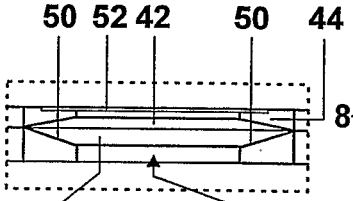
FIG. 21 is an enlarged view of the marked part shown in FIG. 20.
Figure 26:
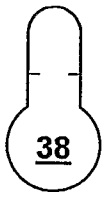
FIG. 26 shows a tamper evident tab provided for the tamper evident means.
Figure 27:
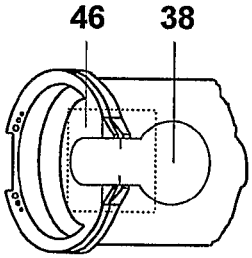
FIG. 27 is a view like FIG. 4 which shows how the tamper evident tab is adhered to the lid, fixing member and body portion.

The Smarties 4 are placed in the body portion 6, the lid 8 is closed into the strengthening member 7, and the strengthening member 7 is fixed to the body portion 6. The tamper evident tab 38, as shown in FIG. 26, is applied to the lid 8, the strengthening member 7 and the body portion 6 to form the tamper evident means. The tamper evident tab 38 extends between the lid 8, the strengthening member 7 and the body portion 6 as shown in FIGS. 4, 17 and 27. The tamper evident tab 38 may be a paper backed hologram tamper evident tab which tends easily to disintegrate on an attempt to remove the tamper evident tab 38. The tamper evident tab 38 helps to stop people such as customers or shop assistants eating a few Smarties 4 prior to sale of the tubular container 2. The tamper evident tab 38 also helps to stop anybody trying to contaminate the contents of the tubular container 2. The tamper evident tab 38 is first broken and then the lid 8 can be opened, for example by pressing on the pressable area 14, or by levering the lid 8 up by applying finger or thumb pressure in the gap 34, or by breaking the tamper evident tab 38 with a thumbnail and at the same time pressing the pressable are 14. Access to the gap 34 is facilitated by a slot 40 in the bead 24 on the strengthening member 7, and also a radius 42 on a bead 44 on the lid 8, as best shown in FIGS. 3, 17 and 21. The tamper evident tab 38 extends from the pressable area 14 on the body portion 6 over the strengthening member 7 and over a curved portion 46 of the lid 8 as shown in FIGS. 2 and 27. The tamper evident tab 38 can be arranged easily to break and in a desired direction by providing the tamper evident tab 38 with easy to tear directional slits or perforations. When the tamper evident tab 38 is broken with a fingernail, one side of the tamper evident tab 38, is forced up against the slope 42 of lid 8, and the other side of the tamper evident tab 38 is forced down on slope 48 of the strengthening member 7. This makes the broken tamper evident tab 38 then difficult to peel off and re-instate to try and hide a previous opening.

Figure 22:
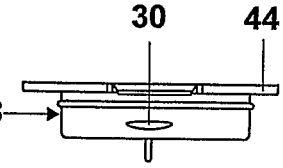
FIG. 22 is a rear view of the lid remote from the fixing member.

FIG. 22 shows the lid 8 from the hinge side of the lid, remote from the fixing member 7.

Figure 23:
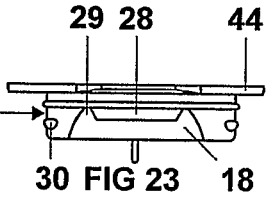
FIG. 23 is a front view of the lid remote from the fixing member.
Figure 24:
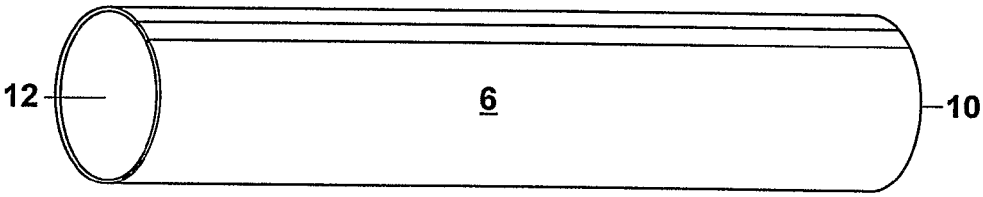
FIG. 24 shows the body portion remote from the lid, fixing member and end closure member.

FIG. 23 shows the lid 8 from the concave portion 18 side of the lid. The recess 48 on the strengthening member 7 helps to ensure that there is enough depth for the tamper evident tab 38 to break when pushed in by a fingernail or thumbnail. This recess 48 which appears after the tamper evident tab 38 has been removed, is best seen from FIGS. 10, 17 and 21. As shown most clearly in FIGS. 10 and 21, angled slopes 50 formed on the bead 24 of the strengthening member 7 act as locators for a thumbnail or fingernail of a person requiring to break the tamper evident tab 38 and/or levering the lid 8 off the strengthening member 7 without the popping sound.

Figure 5:
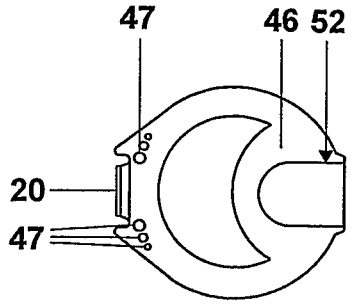
FIG. 5 is a top view of the tubular container in its closed condition.
Figure 6:
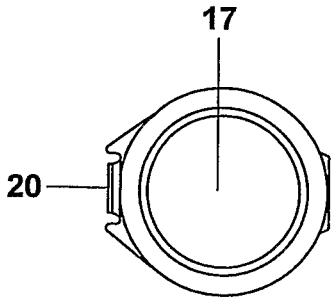
FIG. 6 is a bottom view of the tubular container in its closed condition.

As can best be seen from FIGS. 5, 17 and 21, the lid 8 has a curved portion 46. The curved portion 46 has a shallow indent 52 that contains the tab 38 so that it would be difficult to get a thumbnail or fingernail under the edges of the tamper evident tab 38 in an attempt to remove it.

As can best be seen from FIGS. 1-4, the container 2 is such that the lid 8 and the end closure member 17 extend beyond the periphery of the body portion 6. This is advantageous if the container 2 is being shaken, for example to see how many Smarties 4 are left. More specifically, the overlapping parts of the lid 8 and the end closure member 17 act as flanges which help to stop the body portion 6 slipping out of a person's hand and act as a natural barrier protecting the body portion 6 from damage.

Figure 25:
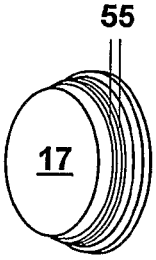
FIG. 25 shows a three dimensional view of the end closure member remote from the body portion.

The end closure member 17 as shown in FIGS. 1, 4 and 25 may be manufactured to have a design which gives children visual enjoyment. The design may be made by embossing or de-bossing. Thus, where the design is, the plastics material of the end closure member 17 is sufficiently thin that, if a child looks through the body portion 6 when it is empty and when it is held up to a light source, the design can be seen as a silhouette. The design may be, for example, a cartoon character such as a Smarties' monster, providing a character merchandising aspect to the tubular container of the present invention. As can best be seen from FIGS. 1 and 2, the closure member 17 is able to be viewed through a body portion 6. This is advantageous because the darkness created inside the body portion 6 intensifies the light passing through the end closure member 17, producing a well defined silhouette. The end closure member 17, as shown in FIGS. 2, 4, 24 and 25, is fixed into the body portion 6 at the end 10. The design image that is debossed or embossed on the front flat surface of end closure member 17 is encapsulated by the body portion 6 so that the image cannot be identified from the outside.

The lid 8 has a projecting portion 58 which acts as a registration means enabling the tubular container 2 to be correctly aligned for receiving the tamper evident tab 38, as shown in FIGS. 7, 12, 14 and 15. The projecting portion 58 can also be advantageous in that, if the lid 8 is swallowed sideways and gets stuck in a person's throat, the person can breathe through the horizontal area near the projecting portion 58.

Figure 8:
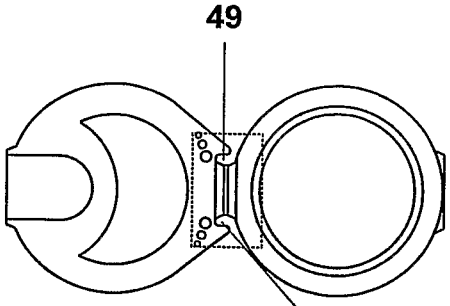
FIG. 8 is an underneath plan view of the tubular container with the lid in a fully open position.

As shown in FIG. 5, the lid 8 is provided with apertures 47. These apertures 47 provide airways in the event that the lid 8 should be swallowed and should become stuck in a person's throat. FIGS. 8 and 11 are provided with indents 49 also to provide airways in the event that the lid 8 should be swallowed and should become stuck in a person's throat.

FIGS. 7 and 12 show V-shaped portions 51 and 59. These help to control the flexibility and therefore the degree of deformation of the strengthening member 7. FIG. 12 also shows a sealing bead 53 for facilitating the formation of the audible pop on opening. The sealing lead 53 also provides a good quality seal which may be required for some products in the tubular container 2.

FIGS. 12 and 25 also show how the tubular container 2 is provided with traversely extending ridges 55. The ridges 55 are provided on the strengthening member 7 and on the end closure member 17. The ridges 55 assist, with or without an adhesive, in firmly retaining the strengthening member 7 and the end closure member 17 in position in the body portion 6.

It is to be appreciated that the embodiment of the invention described above with reference to the accompanying drawings has been given by way of example only and that modifications may be effected. Thus, for example, the tubular container 2 may be used for containing products other than confectionery. Thus for example, the tubular container 2 may be of a larger diameter than the illustrated tubular container 2 and it may be for receiving gravy granules, dried food products or a wide variety of liquids in bottle containers. The body portion 6 may be of a different cross sectional shape than the illustrated circular one. The body portion 6 can be manufactured in a number of different ways. A presently preferred way is to produce the plastics material in sheet form, cut and apply the sheet material to rollers, then off-set print flat, then feed and shape, seam weld into a tube, and cut to length.

Alternatively, the tubular container 2 can be moulded in one or more parts using extrusion or injection moulding technology. Plastics materials other than polyethylene may be employed. The lid 8 may be provided with a letter of the alphabet like the existing Smarties' lid so that various lids 8 may be connected for spelling purposes to provide an educational aspect to the tubular containers of the present invention. With larger tubular containers than the tubular container 2, the tubular containers may open in two stages. Pressing to open may cause a first action in which the lid passes over retaining beads and partially opens. The lid may then be pulled up to the fully open position.

The invention claimed is:

1. A tubular container which comprises a tubular body portion, a lid for closing a first and open end of the body portion, and a strengthening member at the first open end of the body portion, the strengthening member being attached to the lid by a hinge which is formed to be integral with the strengthening member and the lid, the strengthening member being such that it fits inside the first open end of the body portion and defines an opening through which product in the tubular container is obtained, the lid being such that it fits into the opening defined by the strengthening member, the strengthening member being such that it has a skirt portion inside the first open end of the body portion and a pair of oppositely positioned extension members which extend from the skirt portion into the body portion and which are for receiving inward pressure applied to a pressable area of the body directly next to the lid in order to ensure that the strengthening member deforms and causes the lid to pop open and prevents the inward pressure permanently collapsing the first open end of the body portion, the lid having a concave portion for receiving part of the strengthening member that is inwardly deformed by the pressure, the lid having a flap that flexes in response to the inward deformation of the part of the strengthening member, the part of the strengthening member that inwardly deforms pushes the flap upwards as the flap flexes, the concave portion and the flap being such that they are in the opening defined by the strengthening member when the lid is closed on the body portion, the concave portion being such that it faces longitudinally into the body portion when the lid is closed on the body portion, the body portion having a second and closed end, and the lid, the strengthening member and the second and closed end all being made of a plastics material.

2. A tubular container according to claim 1 in which the strengthening member is separately formed from the body portion and pushes into the body portion.

3. A tubular container according to claim 1 in which the end closure member is separately formed from the body portion and pushes into the body portion.

4. A tubular container according to claim 1 in which the body portion is circular in cross section.

5. A tubular container according claim 1 in which the hinge has side edges which are V-shaped so that if the lid is torn from the strengthening member at the hinge, any parts of the hinge on the lid and the strengthening member will have less sharp corners than if the hinge had straight side edges.

6. A tubular container according to claim 1 in which the lid has a closure bead that helps to keep the strengthening member in shape and adds strength to the pressable area when closed.

7. A tubular container according to claim 6 and which is such that when the pressable area is pressed, the flap and the closure bead force against each other and thus help to push the lid upwards, the flap and the closure bead thereby helping to initiate the start of the opening action of the tubular container, and the tubular container also being such that, because the flap is flexible, the flap then flexes and springs off the strengthening member to open the tubular container and create an audible pop.

8. A tubular container according to claim 1 in which the closed second end is provided with a design that can be viewed by looking through the body portion from the first open end in the manner of a telescope.

9. A tubular container according to claim 8 in which the closed second end is such that the light intensity of a silhouette of the design is increased when the design is viewed looking through the body portion from the first open end in the manner of a telescope.

10. A tubular container according to claim 1 and including tamper evident means.

11. A tubular container according to claim 10 in which the tamper evident means is a tamper evident tab which extends between the lid, the strengthening member and the body portion.

12. A tubular container according to claim 11 in which the tamper evident tab is a hologram tamper evident tab.

13. A tubular container according claim 10 in which the tamper evident means has easy to tear directional slits.

14. A tubular container which comprises a tubular body portion, a lid for closing a first and open end of the body portion, and a strengthening member at the first open end of the body portion, the strengthening member being attached to the lid by a hinge which is formed to be integral with the strengthening member and the lid, the strengthening member being such that it fits inside the first open end of the body portion and defines an opening through which product in the tubular container is obtained, the lid being such that it fits into the opening defined by the strengthening member, the strengthening member being such that it has a skirt portion inside the first open end of the body portion and a pair of oppositely positioned extension members which extend from the skirt portion into the body portion and which are for receiving inward pressure applied to a pressable area of the body directly next to the lid in order to ensure that the strengthening member deforms and causes the lid to pop open and prevents the inward pressure permanently collapsing the first open end of the body portion, the lid having a concave portion for receiving part of the strengthening member that is inwardly deformed by the pressure, the lid having a flap that flexes in response to the inward deformation of the part of the strengthening member, the part of the strengthening member that inwardly deforms pushes the flap upwards as the flap flexes, the concave portion and the flap being such that they are in the opening defined by the strengthening member when the lid is closed on the body portion, the concave portion being such that it faces longitudinally into the body portion when the lid is closed on the body portion, the body portion having a second and closed end, the lid, the strengthening member and the second and closed end all being made of a plastics material, the lid having a closure bead that helps to keep the strengthening member in shape and adds strength to the pressable area when closed, the tubular container is such that when the pressable area is pressed, the flap and the closure bead force against each other and thus help to push the lid upwards, the flap and the closure bead thereby helping to initiate the start of the opening action of the tubular container, and the tubular container also being such that, because the flap is flexible, the flap then flexes and springs off the strengthening member to open the tubular container and create an audible pop.

* * * * *